US008745907B2

(12) United States Patent
Boltz et al.

(10) Patent No.: US 8,745,907 B2
(45) Date of Patent: Jun. 10, 2014

(54) PANEL FASTENING ASSEMBLY AND METHOD OF USING THE SAME TO DISPLAY AN ADVERTISING PANEL

(75) Inventors: Eric S. Boltz, Akron, OH (US); Scott A. Miller, Navarre, OH (US); Erik M. Baker, Massillon, OH (US)

(73) Assignee: !maginethis Renovations, LLC, Navarre, OH (US)

( * ) Notice: Subject to any disclaimer, the term of this patent is extended or adjusted under 35 U.S.C. 154(b) by 374 days.

(21) Appl. No.: 12/891,932

(22) Filed: Sep. 28, 2010

(65) Prior Publication Data

US 2012/0073173 A1 Mar. 29, 2012

(51) Int. Cl.

| | |
|---|---|
| ***G09F 7/22*** | (2006.01) |
| ***G09F 7/18*** | (2006.01) |
| ***G09F 7/20*** | (2006.01) |
| *G09F 1/10* | (2006.01) |

(52) U.S. Cl.

CPC ... *G09F 7/22* (2013.01); *G09F 7/20* (2013.01); *G09F 7/18* (2013.01); *G09F 1/10* (2013.01)

USPC ..... 40/617; 40/601; 40/605; 40/606.11; 40/606.14; 248/515; 248/516; 248/539; 248/514; 116/28 R

(58) Field of Classification Search

CPC ..... G09F 7/22

USPC ..... 40/601, 605, 606.11, 606.14, 617, 591; 116/28 R; 248/515, 516, 539, 514

See application file for complete search history.

(56) References Cited

U.S. PATENT DOCUMENTS

| | | | | | |
|---|---|---|---|---|---|
| 2,540,584 | A * | 2/1951 | Jaycox | 248/515 |
| 2,548,351 | A * | 4/1951 | Coombs | 248/516 |
| 3,643,902 | A * | 2/1972 | Gualano | 248/539 |
| 4,063,704 | A * | 12/1977 | Rother | 248/515 |
| 4,375,134 | A * | 3/1983 | Sheetz | 40/591 |
| 4,932,152 | A * | 6/1990 | Barlotta et al. | 43/21.2 |
| 5,305,704 | A * | 4/1994 | Olaniyan | 362/540 |
| 6,402,116 | B1 * | 6/2002 | Northup | 248/514 |
| 7,437,843 | B2 * | 10/2008 | Lefebvre | 40/601 |

* cited by examiner

*Primary Examiner* — Syed A Islam
(74) *Attorney, Agent, or Firm* — Sand & Sebolt

(57) ABSTRACT

A panel fastening assembly comprising a frame member securable to a beam, an advertising track, a rod mating the frame member and the advertising track, a carrier for retaining an advertising panel therein, and wherein the carrier is secured to the advertising track to display the advertising panel. A method of displaying an advertising panel comprising the steps of engaging an advertising panel with a carrier, attaching a frame member to a beam, attaching a rod to the frame, coupling an advertising track to the carrier, and securing the advertising track to the rod.

19 Claims, 13 Drawing Sheets

PANEL FASTENING ASSEMBLY AND METHOD OF USING THE SAME TO DISPLAY AN ADVERTISING PANEL

BACKGROUND OF THE INVENTION

1. Technical Field

The invention relates generally to advertising materials or panels for display within a stadium or arena. More particularly, the invention relates to a panel fastening assembly that is secured to a support structure of a stadium bleacher. Specifically, the invention relates to a panel fastening assembly where advertising panels can be selectively secured to the bleacher support structure by way of adjustable fastening and tensioning components.

2. Background Information

Advertising is a large industry in the United States and includes both printed media and electronic formats. Printed media comes in a variety of forms and may include banners and advertising billboards.

While advertising banners or panels are well known in the advertising industry, they are generally held in place with eyelets welded in the corners of the banner and string or yarn secured through the eyelet to a pole. The banner length then must be precise to fit within the area defined by the support poles or an unsightly amount of string will be necessary to secure the advertising panel to the pole. Advantageously, the use of string to secure the banner makes removal and replacement extremely easy for both the owner, as well as for, vandals or thieves.

Banners are traditionally used in smaller venues such as high school football stadiums, along fences, or on the back of a bleacher. As discussed above, traditional eyelets are typically used to secure the banner to the fence or bleacher. While the advertising banners may adequately display an image, they do not appear professional or particularly pleasing to the audience.

SUMMARY OF THE INVENTION

The present invention broadly comprises a panel fastening assembly that is used in an advertising display system. The panel fastening assembly includes a frame member that is secured to a support beam, an advertising track, a rod that couples the frame member and the advertising track together, and a carrier for securing an advertising panel to the advertising track.

The present invention also broadly comprises a method of displaying an advertising panel including the steps of coupling an advertising panel to a carrier, attaching a frame member to a beam, attaching a rod to the frame member, and securing the advertising track to the frame member with the rod.

BRIEF DESCRIPTION OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

The advertising display system of the present invention is indicated generally at 20, and is particularly shown in FIGS. 1 through 11. Display system 20 includes a panel fastening assembly and an advertising panel 32 that is selectively engageable therewith.

Figure 1:
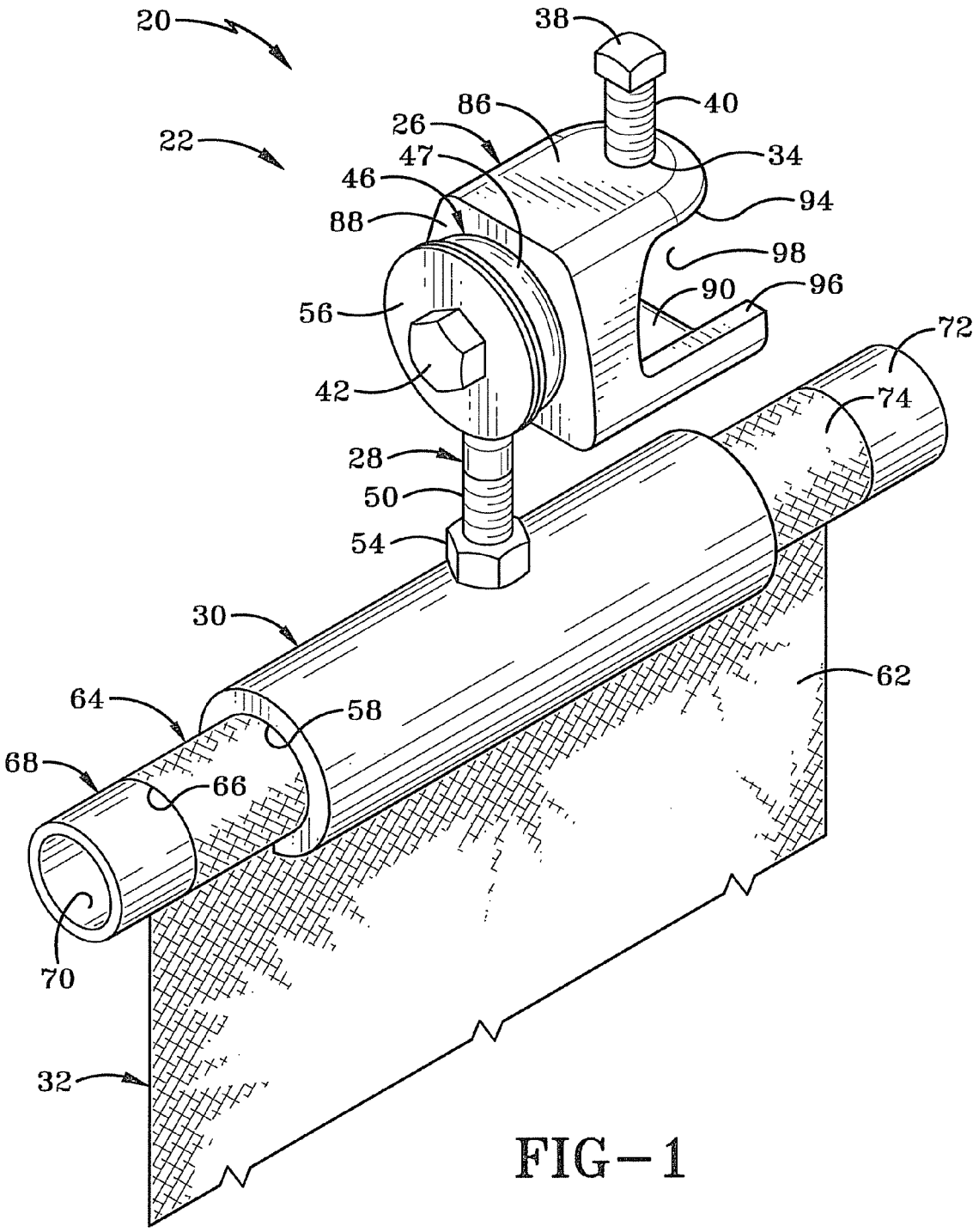
FIG. 1 is a perspective view of a first preferred embodiment of a panel fastening assembly used in an advertising display system in accordance with the present invention.
Figure 2:
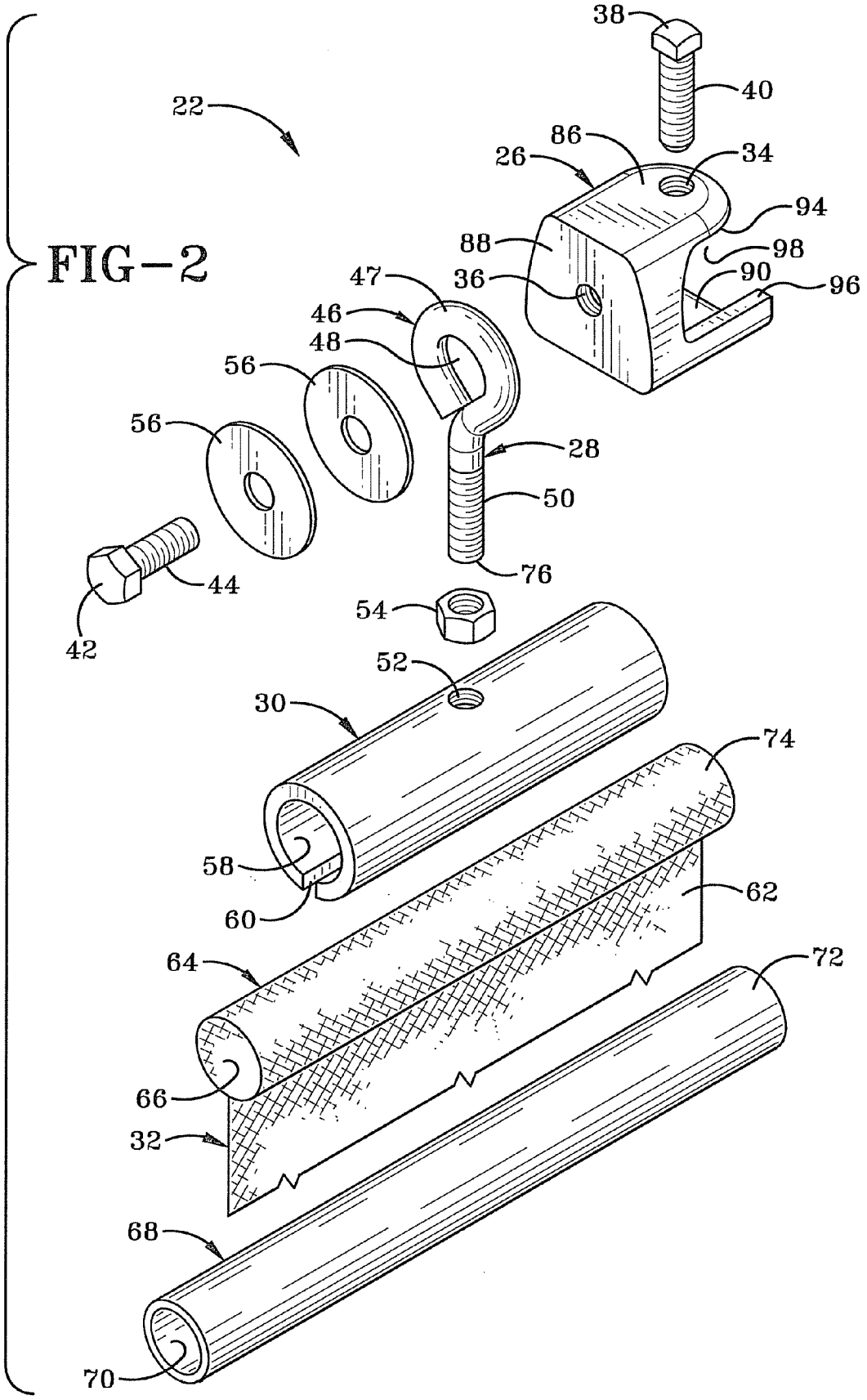
FIG. 2 is an exploded view of the panel fastening assembly of FIG. 1.

FIGS. 1 and 2 show a first preferred embodiment of a panel fastening assembly in accordance with the present invention, with the assembly being generally indicated at 22. Panel fastening assembly 22 comprises a frame member 26, a rod 28, an advertising track 30, and a carrier 68 configured to retain advertising panel 32 therein.

Frame member 26 is generally C-shaped in profile and includes a top wall 86, a rear wall 88, and a bottom wall 90. Top wall 86 defines top hole 34, rear wall 88 defines a rear hole 36, and bottom wall 90 defines a bottom hole 92. Bottom hole 92 is arranged parallel to top hole 34 but preferably is offset relative thereto to allow for the removable attachment of frame member 26 to flange 80 of beam 78 as will be described hereafter. Each of the top hole 34, rear hole 36, and bottom hole 92 is threaded. Both of the top hole 34 and bottom hole 92 are threaded to receive mounting bolt 38 therein. Rear hole 36 is threaded to receive bolt 42 therein. Bolt 38 has threads 40 to mate with one of top and bottom holes 34, 92 and bolt 42 has threads 44 to mate with rear hole 36.

Rod 28 may include a head 46 having a generally circular portion 47 with an opening 48 sized to receive bolt 42 therethrough. Rod 28 includes threads 50 arranged to be mated with a hole 52 in advertising track 30. Rod 28 is secured in a final position on track 30 with a lock nut 54 which may be any traditional type of nut and does not require a specific nylon stop of a lock nut. In the preferred embodiment, a pair of washers 56 is used in conjunction with bolt 42 to secure rod head 46 to frame member 26 via rear hole 36. Advertising track 30 is rotatable about rod 28 and therefore may be configured in a variety or orientations relative to frame member 26. Furthermore, when rod 28 is rotated in a first direction the circular portion 47 thereof moves closer toward an exterior surface of advertising track 30. When rod 28 is rotated in a second direction, the circular portion 47 thereof moves further away from the exterior surface of advertising track 30. Thus, the distance between advertising track 30 and rod 28, and therefore between track 30 and frame member 26 is adjustable by rotating rod 28 in either of the first and second directions.

In accordance with one of the main features of the invention, advertising track 30 preferably is generally tubular and has a chamber 58 which communicates with a longitudinally aligned slot 60 defined in track 30 opposite threaded hole 52. Advantageously, rod 28 can extend partially into chamber 58 of advertising track 30 to act as a locking mechanism for articles or devices that are disposed within chamber 58.

Advertising panel 32 preferably is composed of a sheet material, such as vinyl and may include a plurality of small holes therein that permit air to pass through panel 32 without damaging the material thereof. Although advertising panel 32 is shown and described as being composed of a vinyl material, any suitable material known in the art may be used without departing from the spirit and scope of the present invention as claimed. Advertising panel 32 has a top end, a bottom end, and first and second sides extending between the top and bottom ends. The sheet material of panel 32 is folded back upon itself at the top end and is secured in place by a seam 82 (FIG. 3) to form a ring 64. Ring 64 defines an inner bore 66 therein. The sheet material of panel 32 preferably is also folded back upon itself at the bottom end and is secured in place by a seam to form a second ring. Alternatively or additionally, the sheet material at one or both of the first and second sides is folded back upon itself and secured in place by a seam to form additional rings 64. The advertising panel 32 may therefore have one, two, three or four rings 64 around its perimeter. The area of the panel 32 disposed inwardly of these rings constitutes an advertising portion 62 upon which text and/or designs may be applied or incorporated.

In accordance with one of the main features of the invention, a carrier 68 is provided to engage ring 64. Carrier 68 preferably is generally tubular and defines an inner passage 70 which extends through the length of carrier 68. Unlike advertising track 30, inner passage 70 preferably does not include a slot, although one may be incorporated without departing from the spirit and scope of the present invention. Although carrier 68 is shown and described as being generally tubular, it will be understood that any other cross-sectional configuration may be utilized without departing from the spirit and scope of the present invention as claimed. Carrier 68 is received within bore 66 of ring 64 on advertising panel. An outer surface 72 of carrier 68 is disposed proximate an inner surface the ring 65 that defines bore 66. Carrier 68 and ring 64 are complementary shaped and sized to have a tight fit but the components preferably do not have an interference fit and, consequently, carrier 68 can be removed from bore 66 if desired.

Once carrier 68 is secured within bore 66, advertising track 30 is slidably engaged with ring 64 such that advertising portion 62 of panel 32 extends outwardly through slot 60 of advertising track 30. When this occurs, the outer surface 74 of ring 64 is located within chamber 58 of advertising track 30 and is disposed adjacent the interior surface of track 30 that defines chamber 58. Rod 28 is inserted into hole 52 and is rotated until the terminal end 76 of rod 28 contacts outer surface 74 of ring 64 and locks the same within advertising track 30. Thus, advertising panel 32 extends outwardly from and is securely retained by advertising track 30.

Figure 3:
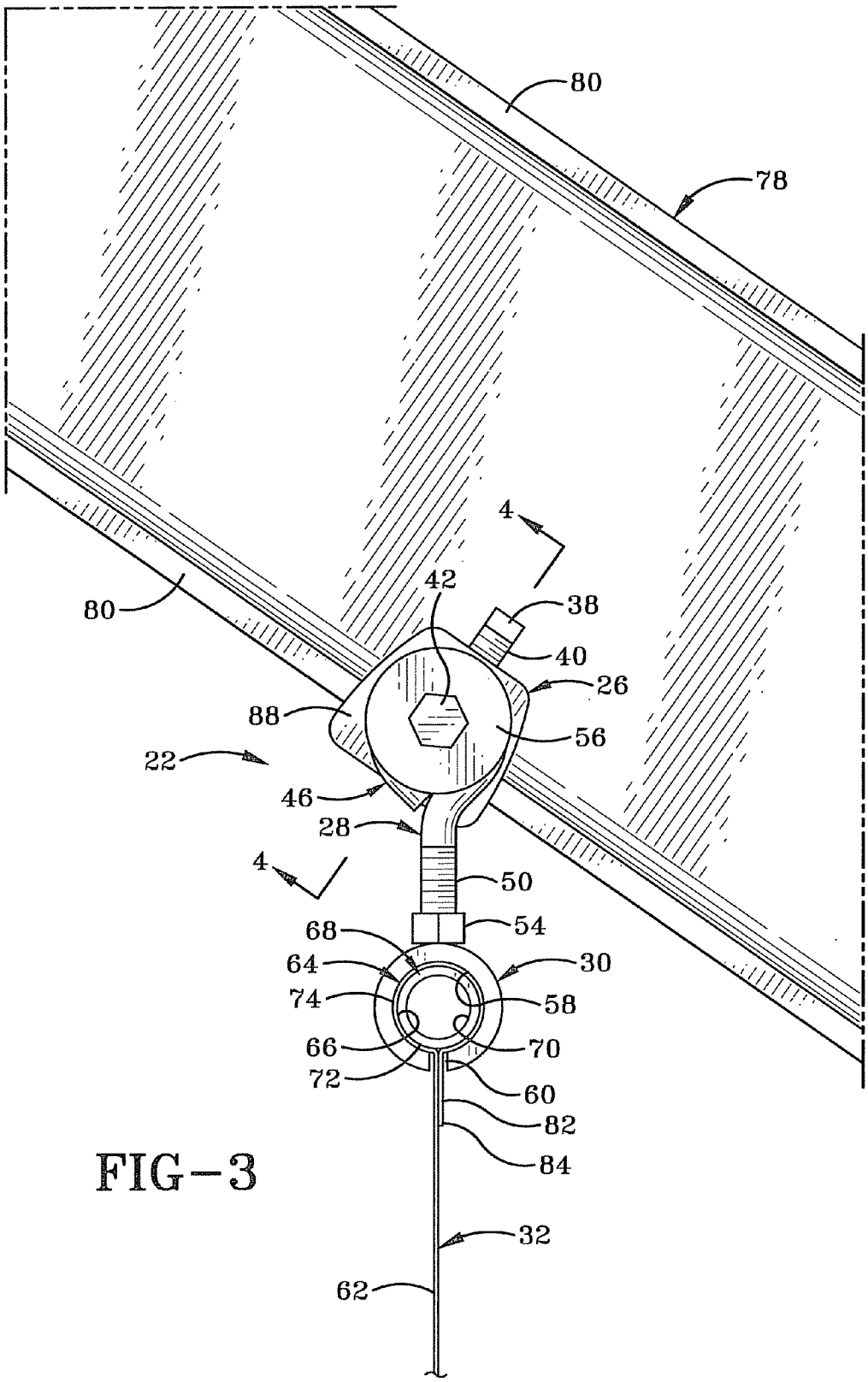
FIG. 3 is a left side elevational view of the panel fastening assembly showing a frame member secured to a beam.
Figure 4:
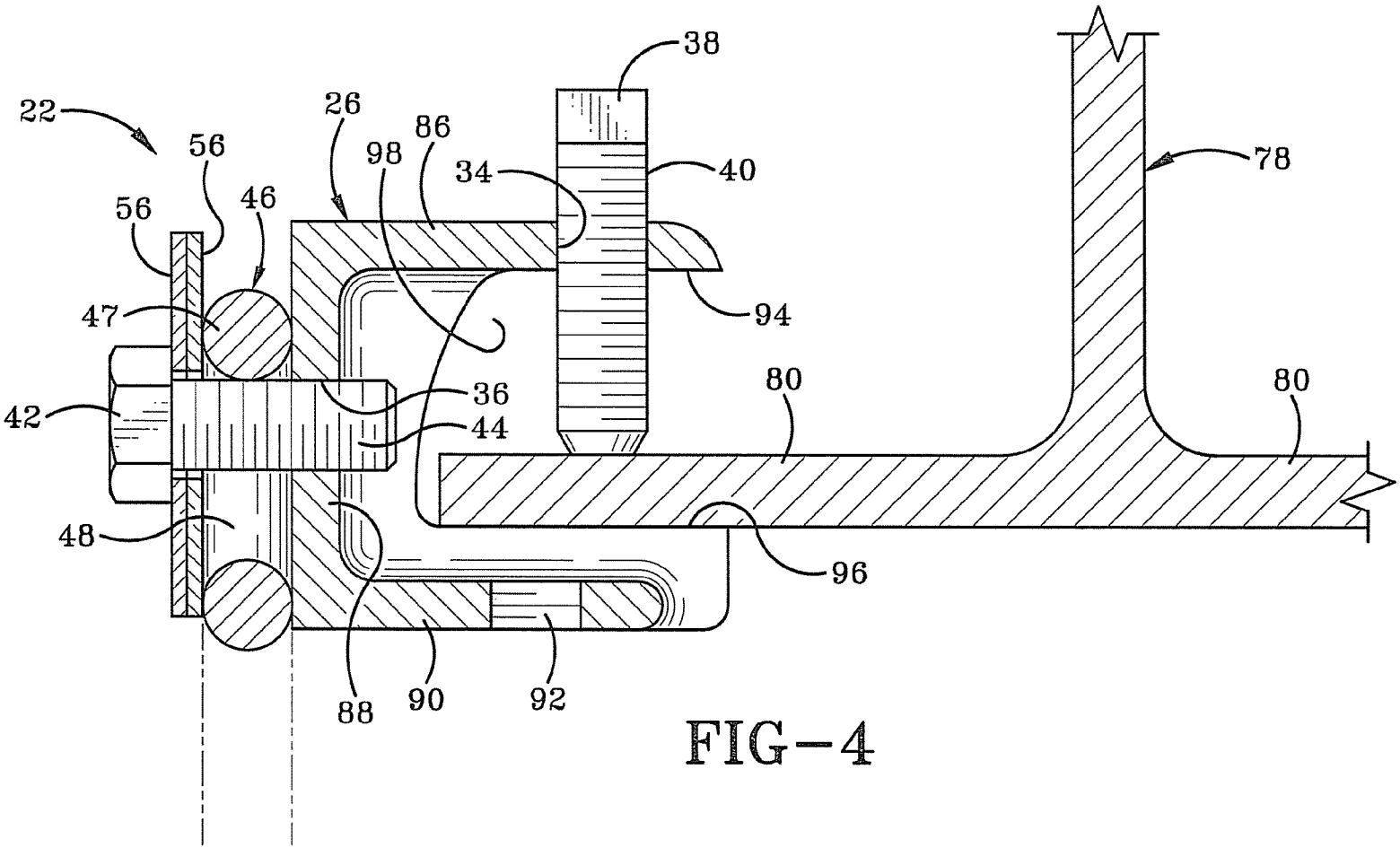
FIG. 4 is a cross-sectional view taken through line 4-4 of FIG. 3.

Referring to FIGS. 3 & 4, panel fastening assembly 22 is shown secured to a beam 78, such as the type of beam that would be present on a bleacher. Beam 78 is illustrated as being disposed at an angle to the vertical. Specifically, beam 78 may be a top rail beam arranged at an angle similar to a bleacher seating surface. Beam 78 preferably is an I-beam that includes a web having a flange 80 at the top and bottom ends of the web. As will be discussed in greater detail below, frame member 26 is arranged to be secured to one of these flanges 80. FIG. 2 shows that advertising panel 32 includes a ring 64 disposed along at least one edge. FIG. 3 shows that ring 64 is formed by folding a terminal edge of panel 32 back onto a section of panel 32 and creating a seam 82 therein. Thus, ring 64 and panel 32 are made from the same sheet material. It will be understood, however, that ring 64 may be made from a different material to panel 32 simply by securing a section of the different material to panel 32 by way of a seam. If panel 32 does not require the panel fastening assembly to be secured to a particular side of panel 32, then a ring 64 would not be formed along that side or the ring could be formed and simply not be used.

FIG. 4 illustrates an enlarged cross sectional view of panel fastening assembly 22 secured to beam 78, and to flange 80 of that beam 78, in particular. Specifically, the installer of the advertising panel system may use either of the top and bottom holes 34, 92 to secure frame member 26 to flange 80. Frame member 26 also includes an inner surface 94 of top wall 86, and an inner surface 96 of bottom wall 90. A cavity 98 is defined between inner surface 94 and inner surface 96. Each of inner surfaces 94, 96 are adapted to abut flange 80, depending on whether top hole 34 or bottom hole 92 are used to locate flange 80 within cavity 98. Specifically, bolt 38 is threaded through either top hole 34 or bottom hole 92 to engage flange 80 and thereby wedge or secure frame member 26 in abutting contact with flange 80. While the first preferred embodiment frame is shown with the inner surfaces 94, 96 being generally disposed at right angles relative to rear wall 88, flat, it is within the spirit and scope of the present invention to incline the inner surface 94 and/or the inner surface 96 relative to rear wall 88 to match the angle of flange 80 as necessary.

Having described the structure of the first preferred embodiment, a preferred method of operation will be described in detail and should be read in light of FIGS. 1 through 4. Advertising panel 32 is formed with seam 82 defining ring 64 which has inner bore 66. Carrier 68 is inserted into inner bore 66 of ring 64 and the combination thereof is inserted into chamber 58 of advertising track 30. Specifically, ring 64 is positioned within track 30 such that the advertising portion 62 of panel 32 is aligned with slot 60 in track 30 and extends outwardly therefrom.

Bolt 38 is threaded through either of top hole 34 or bottom hole 92 of frame member 26, depending on which side of the beam is most easily accessed. Frame member 26 is then positioned so that flange 80 extends into cavity 98. Bolt 38 is rotated until either inner surface 94 of top wall 86 abuts the upper surface of flange 80 or inner surface 96 of bottom wall 90 engages the bottom surface of flange 80. Bolt 38 is tightened to the point that frame member 26 cannot be pulled out of engagement with flange 80. Nut 54 may either be threadably engaged with threads 50 on the shaft of rod 28 and rotated upwardly until a portion of the tip 76 thereof extends outwardly beyond nut 54 or nut 54 may be mounted on the outer surface of track 30 adjacent hole 52 and the threaded shaft of rod 28 is screwed through into nut 54 and into hole 52.

Nut 54 is rotated to thread a length of rod 28 downwardly into chamber 58 of track 30. When a sufficient length of the shaft of rod 28 is received in chamber 58, the tip 76 will engage the exterior surface of the combined ring 64 and carrier 68 and will lock the same in place within track 30. Rod 28 is secured to frame member 26 by inserting bolt 42 through washers 56, through opening 48 and into rear hole 36 in rear wall 88 of frame member 26. Bolt 42 is rotated until rod 28 is tightly retained against rear wall 88 of frame member 26. Thus, track 30 and advertising panel 32 are securely locked to frame member 26. Frame member 26 is then secured to beam 78 as previously described.

In a similar fashion, a second advertising track (not shown) and second frame member (not shown) may be secured to an opposite end of advertising panel 32 from that shown in FIG. 1. The second frame member may also be secured to a second beam that is spaced a distance from beam 78. When the two frame members are secured to the two beams and the rods 28 of the two panel fastening assemblies retain advertising panel 32 in the two opposing tracks 30 thereof, then the advertising panel 32 is tensioned between the two panel fastening assemblies and the graphics and text of any advertising displayed on panel 32 is clearly visible.

Having described the structure and operation of the first preferred embodiment, only those portions of the second embodiment which are different from the first embodiment are described in detail. Likewise, similar numerals refer to similar parts throughout the various embodiments.

Figure 5:
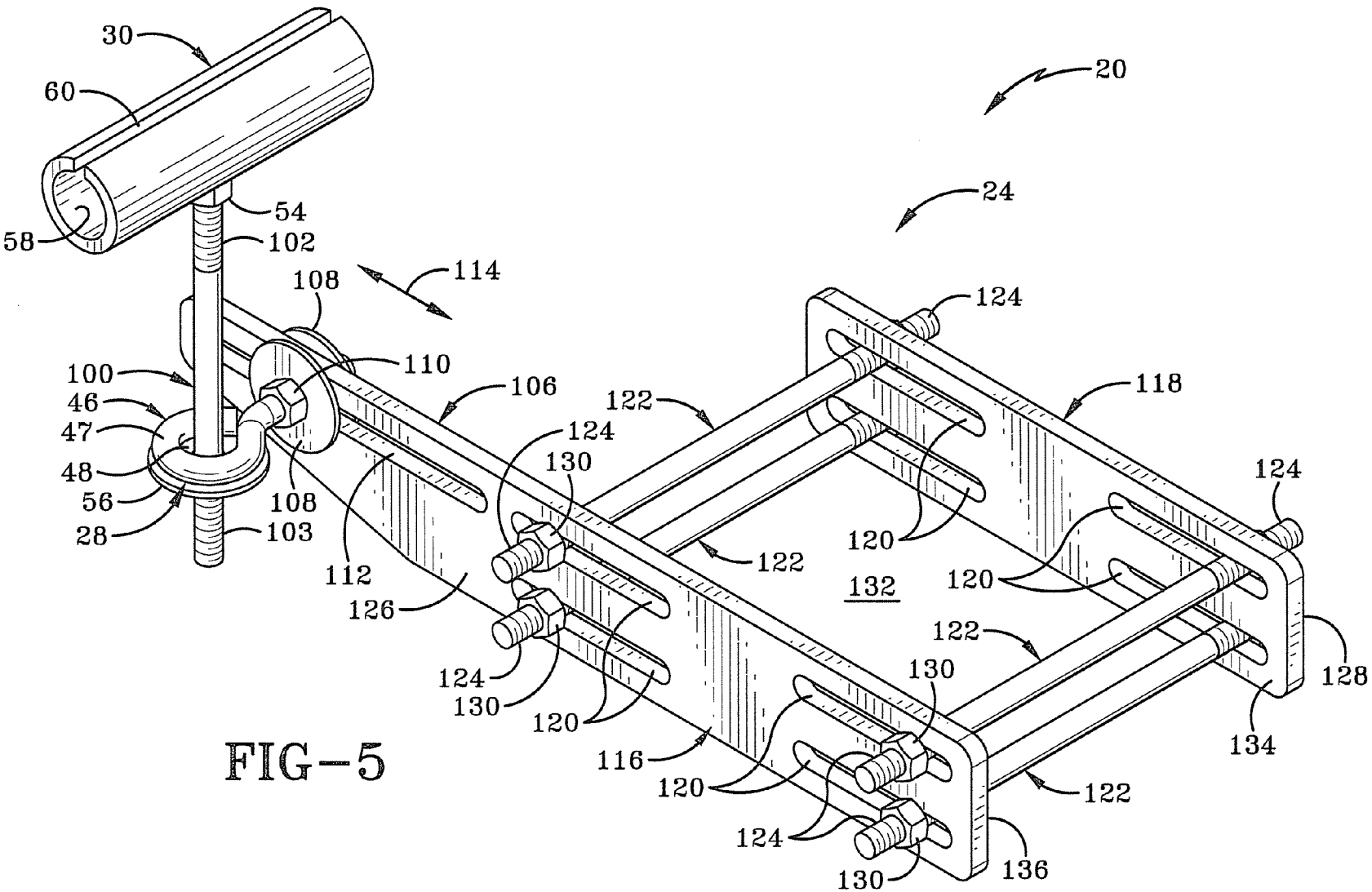
FIG. 5 is a perspective view of a second preferred embodiment of a panel fastening assembly for use in the advertising display system in accordance with the present invention shown prior to installation on a beam.
Figure 6:
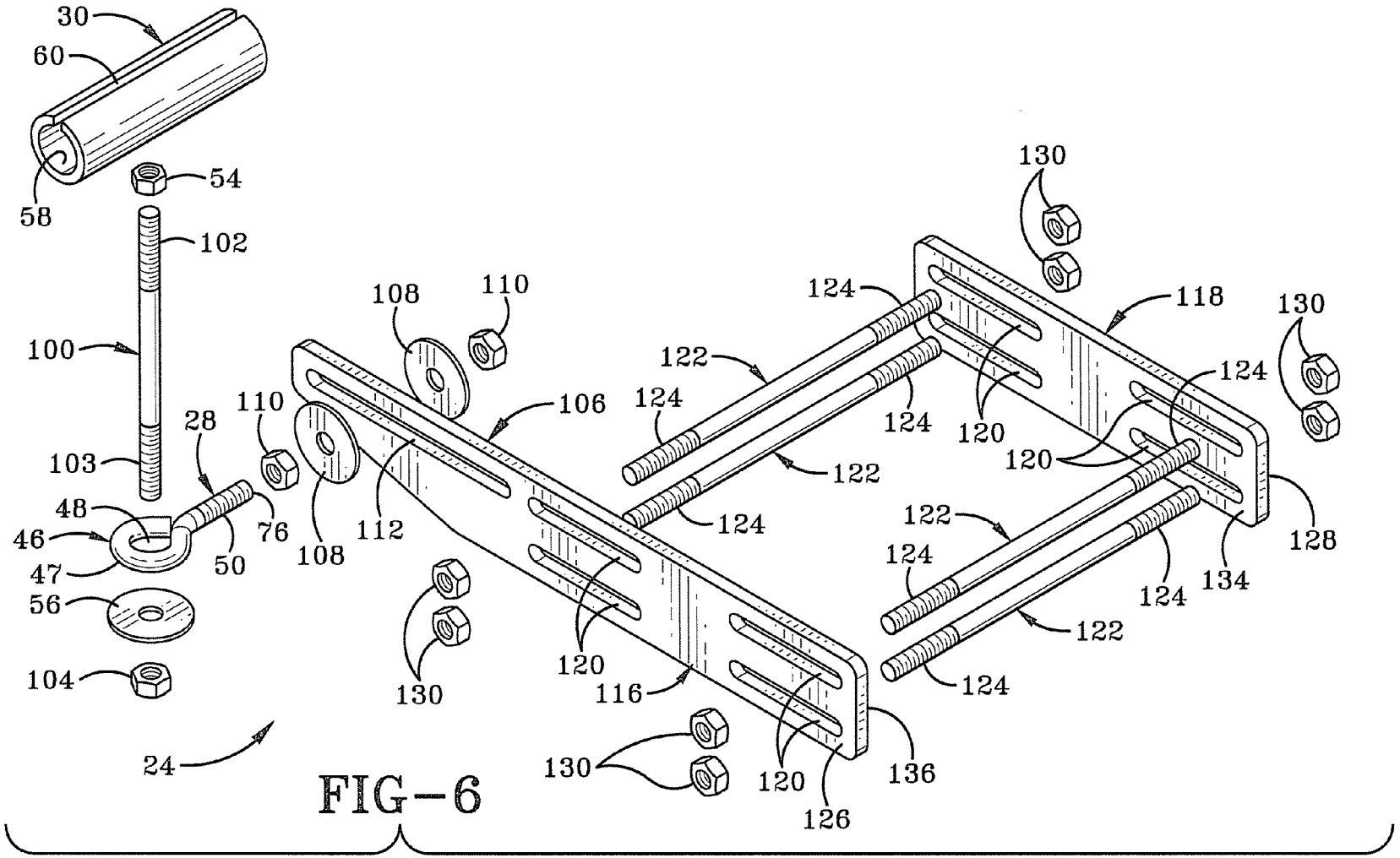
FIG. 6 is an exploded view of the panel fastening assembly of FIG. 5.

FIGS. 5 through 11 illustrate a second preferred embodiment of a panel fastening assembly in accordance with the present invention and generally referenced by the number 24. Referring specifically to FIGS. 5 and 6 and in accordance with another main feature of the invention, advertising track 30 and rod 28 are similar to the panel fastening assembly 22, but panel fastening assembly 24 further includes a second rod 100 that engages rod 28 and track 30 and is operable to vary the distance between the same. Rod 100 includes a threaded portion 102 at a first end and a threaded portion 103 at a second end. Threaded portion 102 is engaged with track 30 and lock nut 54 is used to secure that first end of rod 100 to track 30 in a similar manner as bolt 42 is secured to rod 28 in panel fastening assembly 22. Threaded portion 103 of rod 100 is received through opening 48 of rod 28, and a washer 56 and nut 104 (FIG. 6) are used to vary the distance between track 30 and rod 28, as will be described hereinafter.

Figure 7:
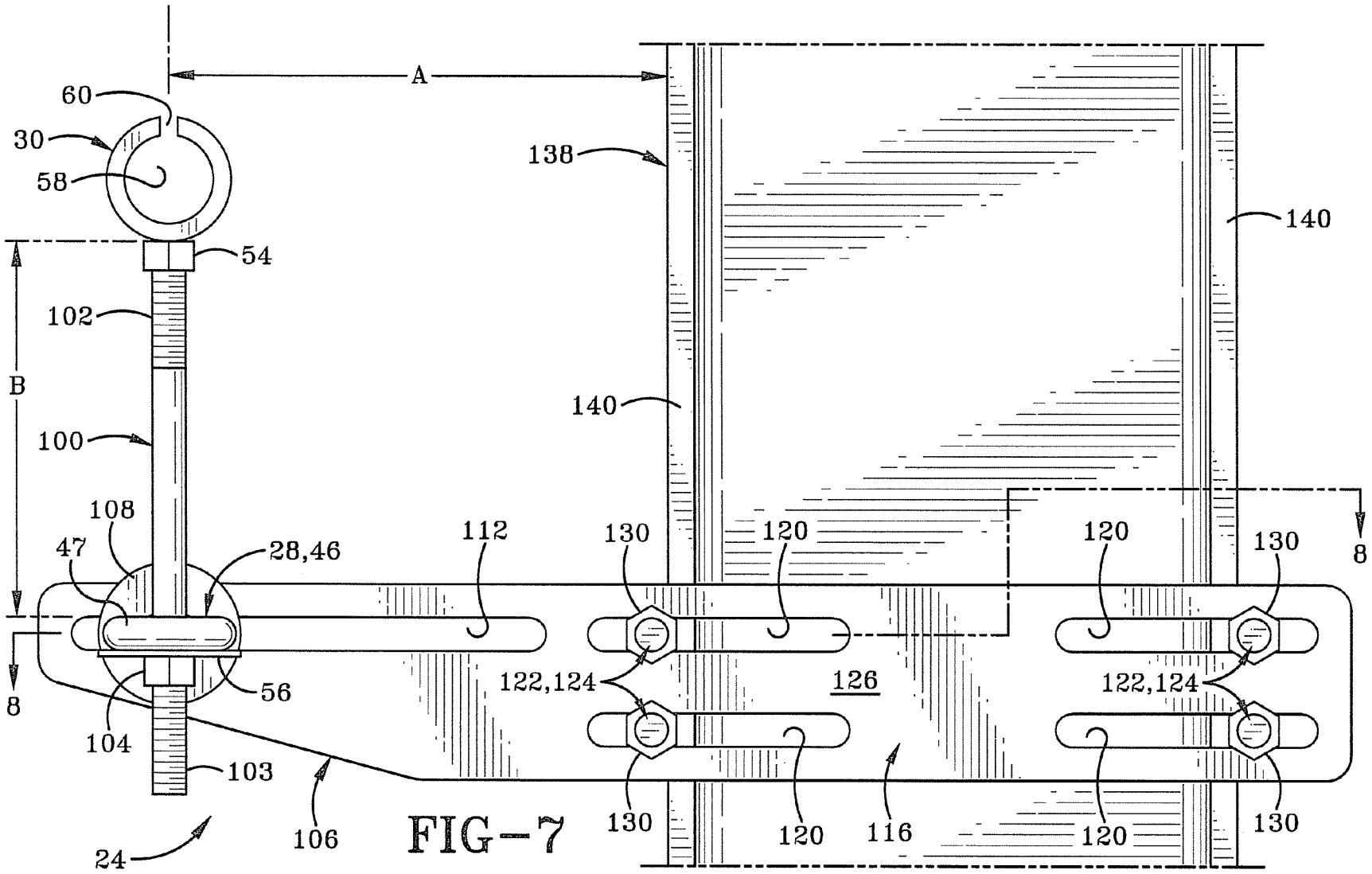
FIG. 7 is a front elevational view of the panel fastening assembly shown secured to a beam.

Panel fastening assembly 24 further includes a frame member 126 which is removably secured to a beam 138 (FIG. 7). Frame member 126 comprises a first arm 106 and a second arm 118 that are connected to each other by way of a plurality of mounting bolts 122. Rod 28 is secured to first arm 106 with a pair of washers 108 and a pair of nuts 110. Specifically, rod 28 is inserted through an elongated slot 112 in first arm 106 and nuts 110 lock the same in position. The position of rod 28 in slot 112 is adjustable as indicated by the arrows 114. In order to move rod 28 in slot 112, nuts 110 are loosened and rod 28 is slid to the desired location. Nuts 110 are then tightened to lock rod 28 in place. Thus, the position of rod 100 and, therefore the advertising track 30 is adjustable along the length of elongated slot 112. This enables the installer to locate the advertising panel (not shown in these figures) at a predetermined location relative to the beam 138.

In accordance with another feature of the present invention, first arm 106 includes a rear portion 116 that is complementary in shape and size to second arm 118. Both of the rear portion 116 and second arm 118 include a plurality of elongated slots 120. The slots 120 on rear portion 116 are aligned with the slots on second arm 118. In the preferred embodiment, four elongated slots 120 are defined in rear portion 116 and four elongated slots 120 are defined in second arm 118. Four mounting bolts 122 are provided to secure first arm 106 and second arm 118 together. Each mounting bolt 122 preferably includes a threaded portion 124 at each end and when bolts 122 are engaged through slots 120 in first and second arms 106, 118, the threaded portion 124 extends beyond the outer surfaces 126, 128 of rear portion 116 and second arm 118, respectively. Nuts 130 are engaged with mounting bolts 122 and abut outer surfaces 126, 128. Once first and second arms 106, 118 are secured together with mounting bolts 122, a cavity 132 is defined by an inner surface 134 of second arm 118, an inner surface 136 of rear portion 116 of first arm 106, and mounting bolts 122. Since slots 120 are elongated longitudinally, the longitudinal position of mounting bolts 122 may be varied as necessary to secure frame member 126 to beam 138, as will be hereinafter described.

Figure 8:
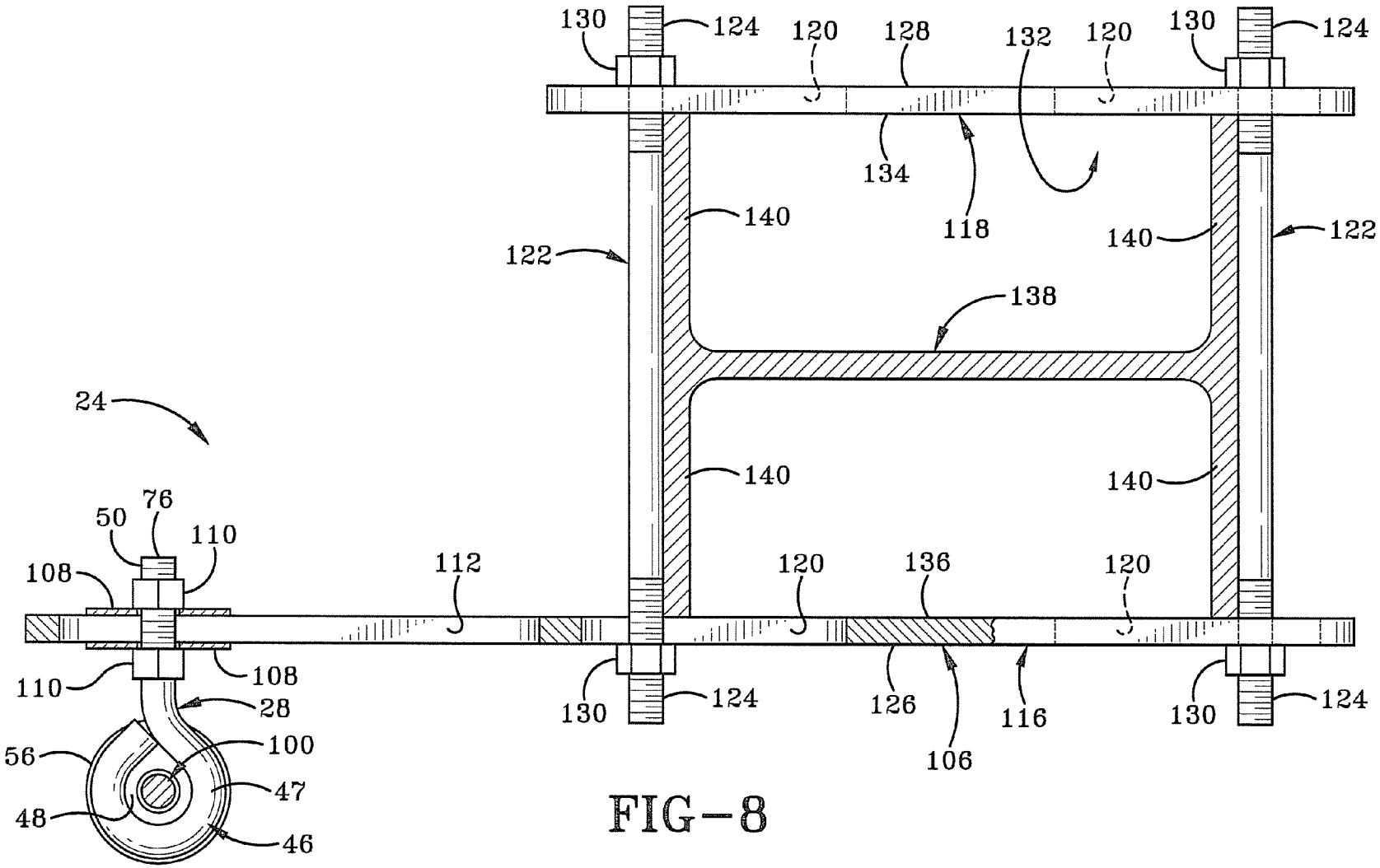
FIG. 8 is a partial cross-sectional view taken generally along line 8-8 in FIG. 7.

FIGS. 7 and 8 illustrate panel fastening assembly 24 secured around a vertical beam 138. Vertical beam 138 is an I-beam having a central web with flanges 140 at either end. Frame member 126 is engaged with beam 138 in such a manner that inner surface 136 of first arm 106 abuts the terminal ends of the flanges 140 on a first side of the web and inner surface 134 of second arm 118 abuts the terminal ends of the flanges 140 on a second side of the web. Mounting bolts 122 are adjusted within slots 120 of first and second arms 106, 118 such that a first pair of bolts 122 are disposed in abutting contact along the length of a first one of the flanges 140 and a second pair of bolts 122 are disposed in abutting contact along the length of a second one of the flanges. Nuts 130 are tightened to secure frame member 126 in place on beam 138. It will be understood that frame member 126 could be rotated through ninety degrees from the manner illustrated in FIGS. 7 & 8. In this second instance, inner surface 136 of first arm 106 would abut the length of the first one of the flanges 140 and inner surface 134 of second arm 118 would abut the length of the second one of the flanges 140. Mounting bolts 122 would engage the terminal ends of the flanges 140. In either event, beam 138 is circumscribed by frame member 126 and frame member 126 is tightly locked into position along the vertical length of the beam 138 by the cooperating nuts 130 and bolts 122. Advantageously, because mounting bolts 122 are secured with elongated slots 120, panel fastening assembly 24 can easily fit beams of various sizes.

FIGS. 7 and 8 further illustrate that the position of advertising track 30 relative to beam 138 may also be offset as desired. The distance between track 30 and beam 138 is indicated by the dimension "A" (FIG. 7). As will be evident, dimension "A" may be adjusted by sliding rod 28 along slot 112 toward or away from beam. This offset can be useful if the beam is spaced further apart from an upper beam or other attachment mechanism for the panel fastening assembly, as well as any overhanging objects that the advertising panel may cover.

The distance between advertising track 30 and frame member 126 is indicated by the dimension "B". As will be evident, dimension "B" may be adjusted by rotating nuts 54, 104 to change the length of the section of bolt 100 that extends between track 30 and rod 28. FIG. 7 illustrates the panel fastening assembly 24 in the lower mounting position. This arrangement is used for securing the bottom edge of the advertising panel (not shown). The height of advertising track 30 and the tension within the advertising panel 32 are adjusted by either tightening or loosening nut 104 on lower threaded portion 102 of the rod 100 and then extending or shortening the section of rod 100 between track 30 and rod 28.

Figure 9:
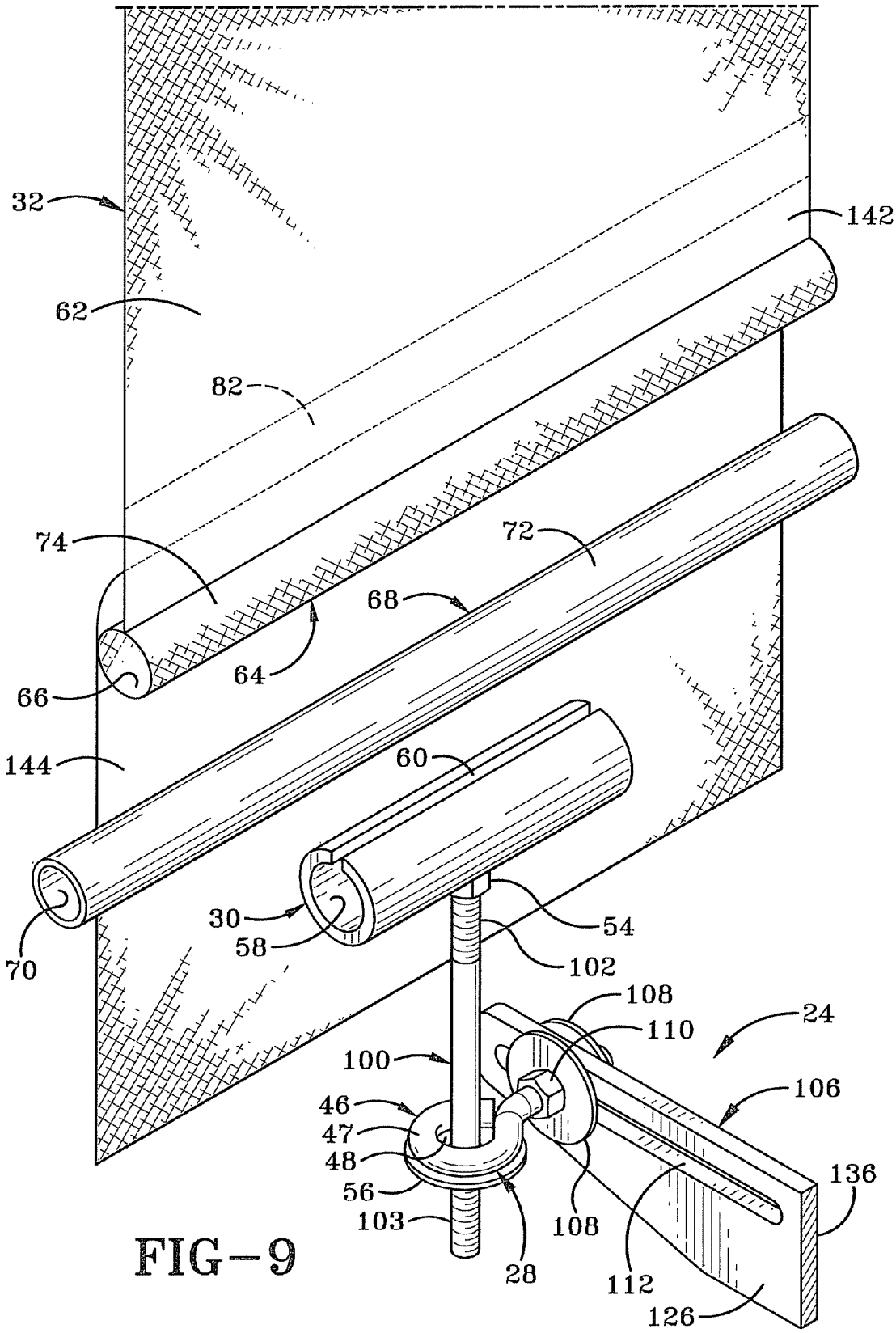
FIG. 9 is a partially exploded view of the panel fastening assembly with the carrier shown separated from the frame member and the advertising panel.
Figure 10:
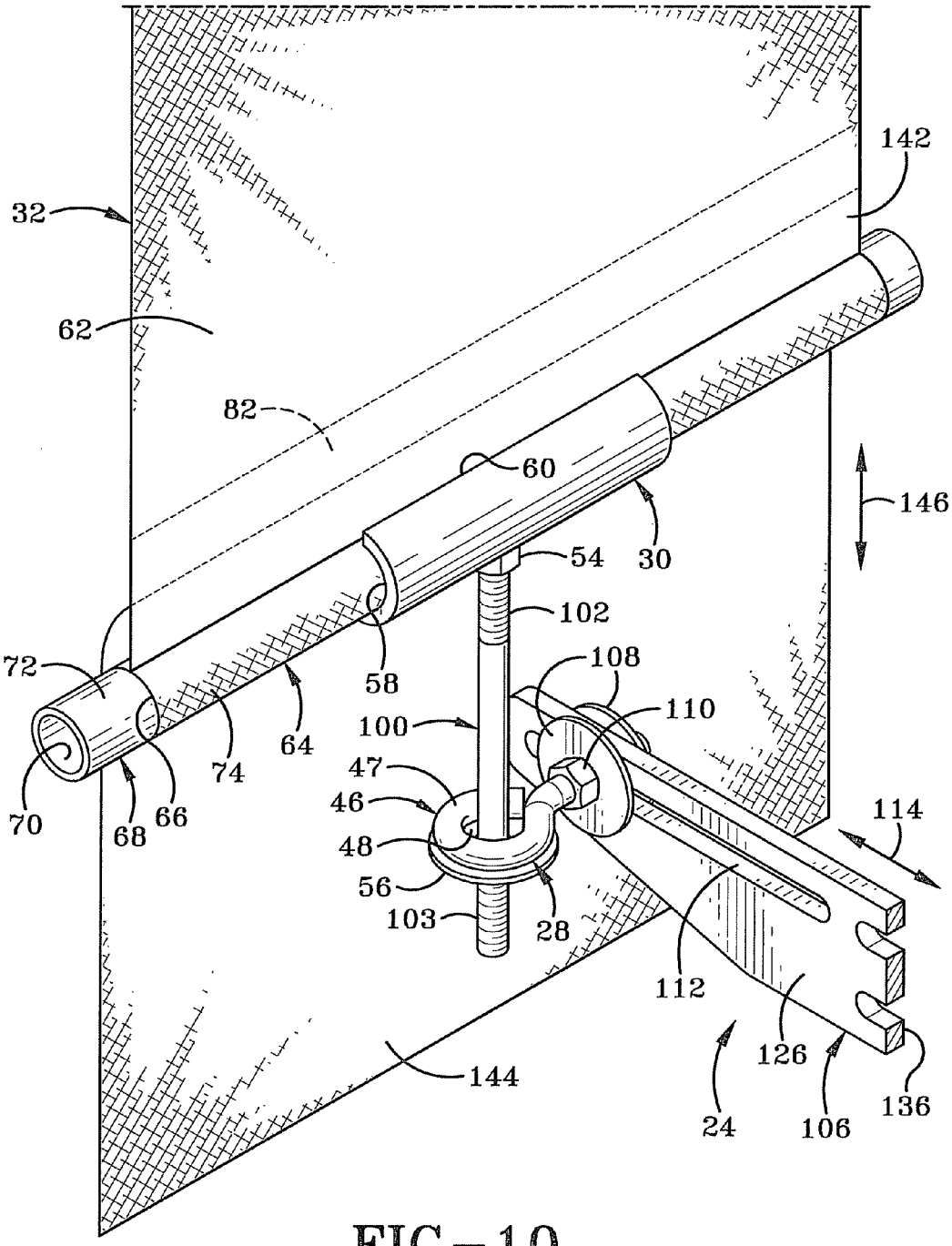
FIG. 10 is a perspective rear view of the panel fastening assembly retaining an advertising panel therein and showing the adjustability of the frame member.

The securement of a bottom end of an advertising panel 32 with panel fastening assembly 24 is illustrated in FIGS. 9 and 10. Advertising panel 32 includes an advertising portion 62 and has a seam 82 formed along its lower end 142. Seam 82 secures a folded region of the lower end of panel 32 back on itself to form ring 64. Additionally, a skirt portion 144 of panel 62 is secured to advertising portion 62 along seam 82. Ring 64 formed on lower end 142 of advertising portion 62 has an outer surface 74 and defines an inner bore 66. As was the case with the first preferred embodiment of the invention, carrier 68 is inserted into inner bore 66 of ring 64 in such a manner that the outer surface 72 of carrier 68 abuts an interior surface of ring 64. Carrier 68 defines a passage 70 therein. The combined carrier 68 and advertising panel 32 are engaged within chamber 58 of advertising track 30 as described with reference to the first preferred embodiment. Consequently, when track 30 is so engaged, advertising portion 62 of panel 32 extends outwardly and upwardly through slot 60 of track 30. Skirt panel 144 hands downwardly from lower end 142 of panel 62 and effectively hides all the components of panel fastening assembly 24 from view. Nut 54 is rotated to lock the combined carrier 68 and panel 32 to advertising track 30.

FIG. 10 illustrates advertising panel 32 engaged with panel fastening assembly 24. Although not illustrated herein, it will be understood that beam 138 is disposed substantially parallel to advertising panel 32 and surrounded by the rear portion 116 of first arm 106 and second arm 118 (not shown in this figure) of frame member 126. It should be noted that when panel fastening assembly 24 is being used to secure advertising panel 32 to a beam, the frame member 126 is positioned vertically beneath advertising track 30. Advertising panel 32 may be drawn closer to the beam or moved further away therefrom by longitudinally adjusting the position of rod 28 in slot 112, as indicated by arrows 114. Additionally, the tension in advertising panel 32 may be adjusted in the directed indicated by arrows 146. The tension is adjusted by changing the relative distance between track 30 and rod 28 by rotating the nut 104 (not shown in these figures) as described with reference to the first preferred embodiment of the invention. Ideally, the tension is adjusted until the advertising panel 32 is pulled substantially taut and free of wrinkles.

Figure 11:
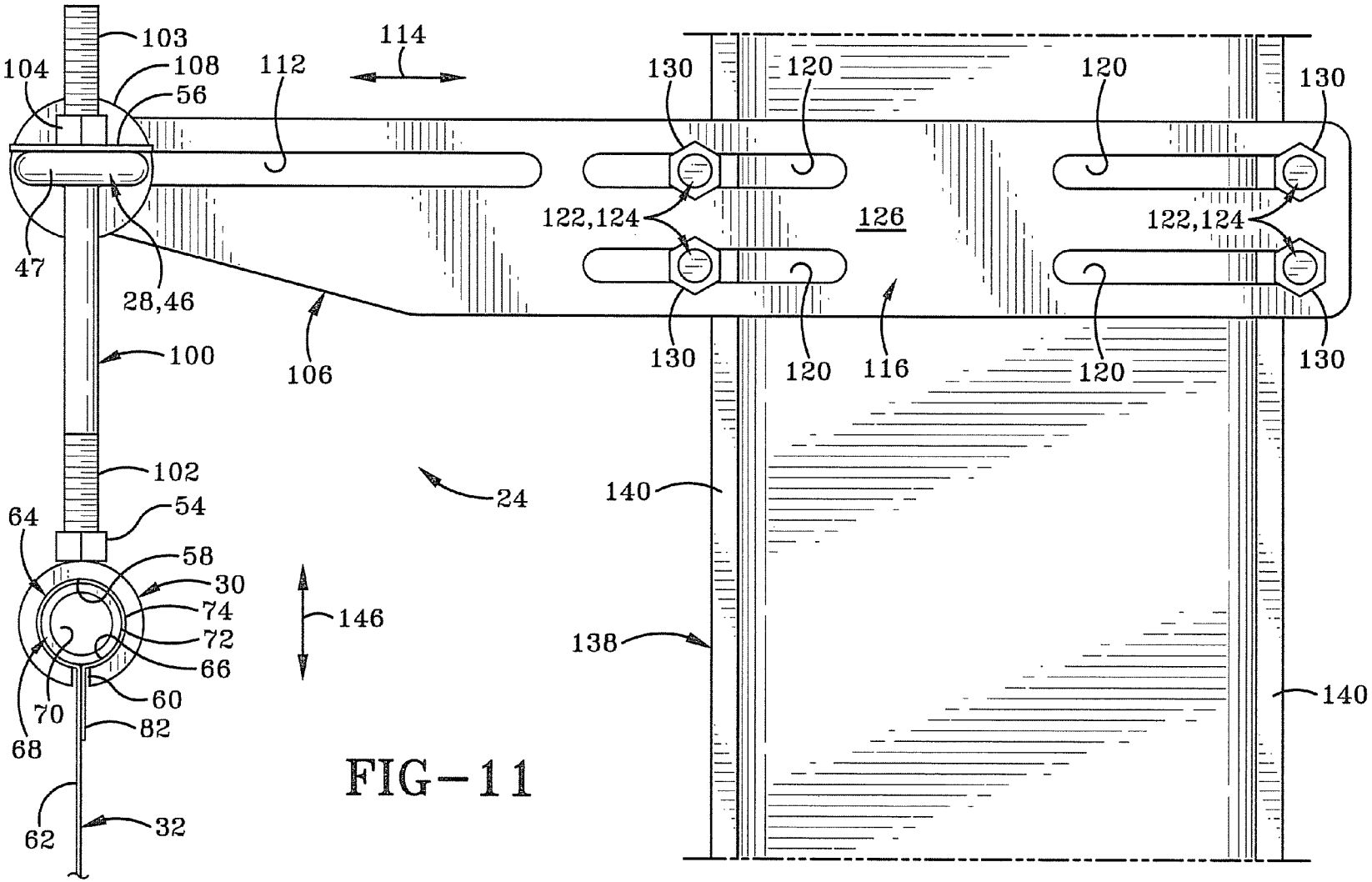
FIG. 11 is a right side elevational view of the panel fastening assembly installed on the beam.

FIG. 11 illustrates panel fastening assembly 24 arranged to secure the top end of advertising panel 32 to the vertical beam 138. In this instance, frame member 126 is positioned vertically above advertising track 30 and advertising panel 32 hangs downwardly from advertising track 30. As was the case with respect to FIGS. 9 & 10, this relative distance between panel 32 and beam 138 is adjusted by sliding rod 28 horizontally along slot 112 in the directions indicated by arrow 114. The vertical distance of advertising panel 32 from frame member 126 is adjusted by rotating nut 104 to effectively lengthen or shorten rod 100 in the directions indicated by the arrows 146. Thus the operator can adjust the tension in the advertising panel 32 by rotating nut 104.

Having described the structure of the second preferred embodiment of the panel fastening assembly 24 in accordance with the present invention, a preferred method of operation will be described in detail and should be read in light of FIGS. 5 through 11. Due to the fact that advertising panel 32 remains virtually identical within both of the first and second preferred embodiments of the invention, with the addition of skirt panel 144 (which does not change the operation of the panel fastening assembly), the attachment of the advertising panel 32 to the advertising track 30 will not be described again as it is identical to that discussed above. Further, the manner of tensioning and positioning of the second preferred embodiment is substantially identical to the first preferred embodiment.

Panel fastening assembly 24 is secured to beam 138 in the following manner. First arm 106 and second arm 118 are arranged on opposite sides of vertical beam 138 and the plurality of mounting bolts 122 are inserted through elongated slots 120. Mounting bolts 122 are secured in place around vertical beam 138 with nuts 130 to form a cavity 132. Vertical beam 138 is retained within this cavity 132. Rod 28 is inserted into elongated slot 112 in first arm 106 and washers 56 and nuts 110 are finger tightened. The position of rod 28 in slot 112 is adjusted and then nuts 110 are rotated to lock rod 28 against further movement in slot 112. Rod 100 is inserted through opening 48 in rod 28. Nut 104 is rotated to adjust the position between track 30 and rod 28. Nut 104 is rotated in a first direction to decrease the distance between track 30 and rod 28 and thereby increase the tension on panel 32. Nut 104 is rotated in a second direction to increase the distance between track 30 and rod and thereby decrease the tension on panel 32. The remainder of the installation is similar to that of the first preferred embodiment. Once again, carrier 68 is inserted within inner bore 66 of ring 64 and the combination is then engaged within advertising track 30 such that advertising portion 62 extends outwardly through slot 60 of track 30. In the installation of track 30 at the bottom end of advertising panel 32, skirt panel 144 hangs downwardly to hide ring 64 and frame member 26.

Figure 12:
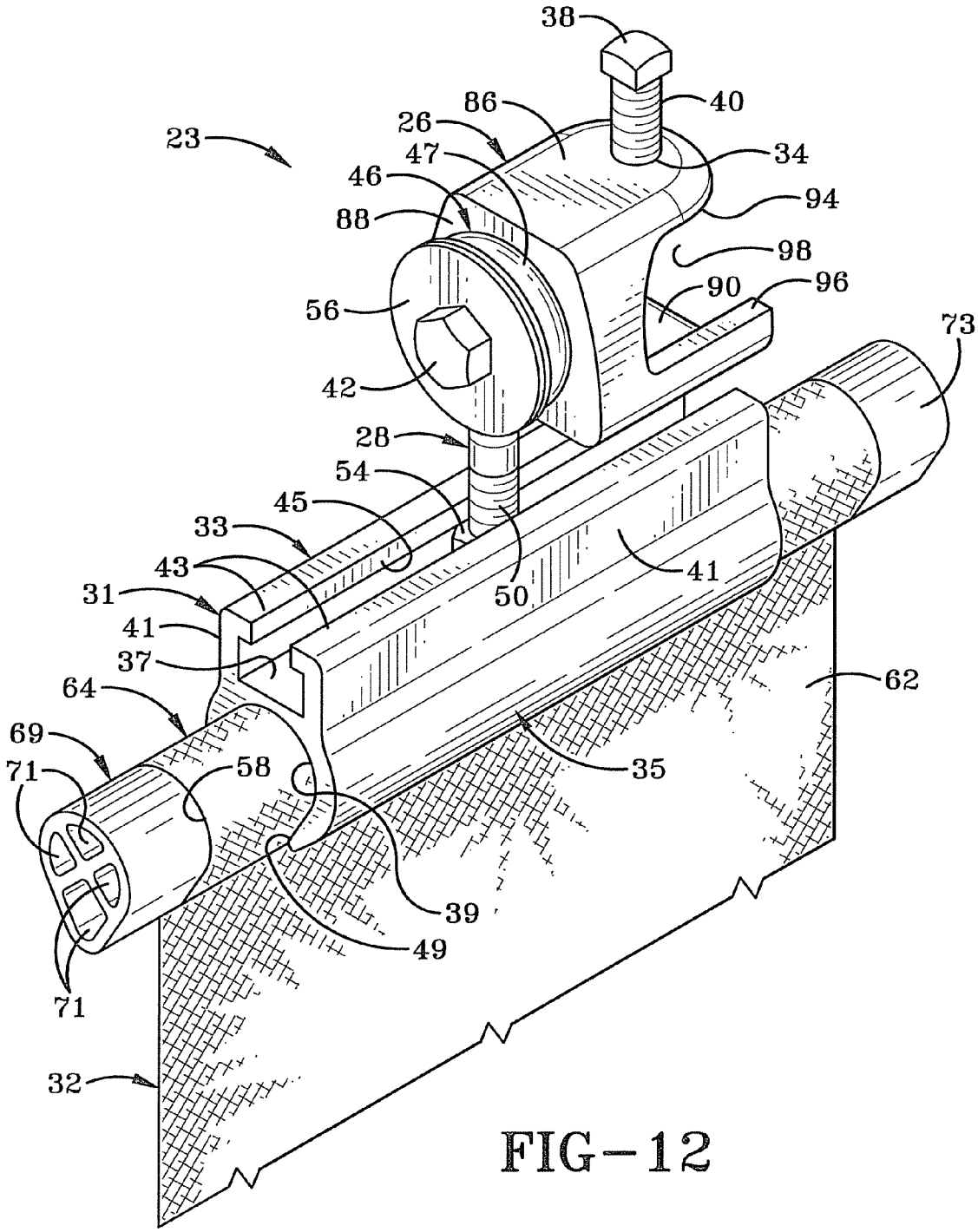
FIG. 12 is a perspective view of a third preferred embodiment of a panel fastening assembly in accordance with the present invention.
Figure 13:
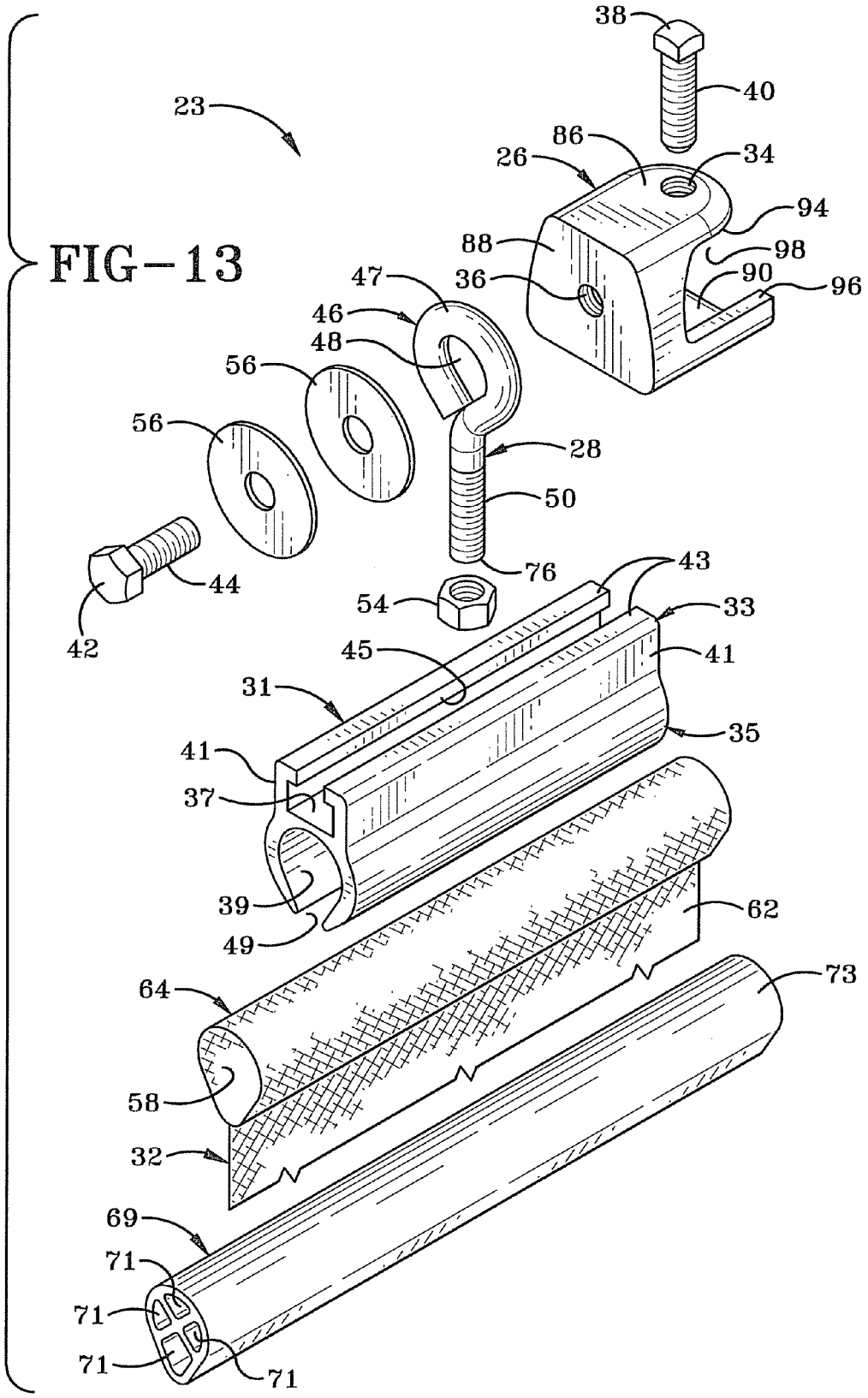
FIG. 13 is an exploded view of the third preferred embodiment of the panel fastening assembly shown in FIG. 12.

FIGS. 11 and 12 illustrate a third preferred embodiment of a panel fastening assembly in accordance with the present invention, with the assembly being generally indicated at 23. While the majority of the components are similar to those of panel fastening assembly 22, assembly 23 includes an advertising track 31 that is differently shaped in cross-section to advertising track 30. Advertising track 31 is an elongate member which includes an upper portion 33 and a lower portion 35. As best seen in FIG. 13, lower portion 35 comprises a generally C-shaped wall when viewed in cross-section. The wall of lower portion 35 defines a longitudinal bore 39 therein and further defines a longitudinal slot 49 between the free ends of the wall. Slot 49 is substantially continuous with bore 39.

Upper portion 33 extends outwardly away from lower portion 35. Upper portion 33 comprises two spaced apart parallel sidewalls 41 that extend vertically upwardly from an inward portion of the C-shaped wall of lower portion 35. Sidewalls 41 extend longitudinally along substantially the entire length of lower portion 35. Upper portion 33 further includes a pair of rails 43 that extend inwardly from the uppermost ends of sidewalls 41 and toward each other. Sidewalls 41 define a longitudinally extending slot 37 between them. Rails 43 are disposed at right angles to sidewalls 41 and define a longitudinally extending opening 45 between them. Opening 45 is substantially continuous with slot 37. Opening 45 is sized to receive the shaft of rod 28 therethrough and slot 37 is sized to receive nut 54 therethrough. Nut 54 cannot pass vertically through opening 45 and thus is retained in the slot 37 by rails 43. This locks rod 28 and upper portion 33 of advertising track 31 together. Slot 49 and located opening 45 are opposite each other.

Carrier 69 is shaped like an inverted tear-drop with a wider portion thereof being complementary sized and shaped to be received in bore 39 of the lower portion 35 of advertising track 31, and a narrower portion thereof being sized and shaped to extend downwardly through slot 49. Carrier 69 is provided with one or more holes 71 that extend longitudinally therethrough. The holes 71 reduce the overall weight of carrier but sufficient material remains extending between the holes 71 so that the structural integrity of carrier 69 is maintained. Preferably, three of the holes 71 are substantially triangular in shape and the fourth hole is substantially diamond-shaped. Carrier 69 includes a substantially X-shaped crosswall that extends longitudinally through the interior of carrier 69. The four arms of the crosswall and an interior surface of the outer wall define the holes 71 therebetween, as illustrated in FIGS. 12 and 13. The shape and location of the crosswall serves to strengthen the outer wall of carrier 69. The apex at the narrowest and lowermost end of carrier 69 is disposed some distance outwardly beyond the free ends of the lower portion 35 of advertising track 31 when carrier 69 is engaged in advertising track 31.

Advertising panel 32 is substantially identical to advertising panel 32 of the previous embodiments and is provided with a ring 64 along one or more of the side edges. Ring 64 has a longitudinal chamber 58 extending therethrough. However, because of the shape of exterior wall 73 of carrier 69, when carrier 69 is inserted into chamber 58 of advertising panel 32, chamber 58 is deformed to become substantially complementary to the shape of wall 73.

Panel fastening assembly 23 is used in the following manner. Carrier 69 is inserted into chamber 58 of the ring 64 of advertising panel 32 and then the combined carrier 69 and panel 32 are inserted into bore 39 of advertising track 31 in such a way that the advertising portion 62 of panel 32 extends outwardly from slot 49 of track 31. Rod 28 is engaged with advertising track 31 by sliding nut 54 into slot 37 and the shaft having threads 50 therein is received in opening 45. When rod 28 is rotated, the terminal end 76 thereof engages the wall of lower portion 35 inside slot 37. Nut 54 is caused to engage the interior surfaces of rails 43 and rod 28 is thereby locked to advertising track 31. Thus, when rod 28 is secured to frame member 26 as previously described herein, advertising track 31 and therefore advertising panel 32 are engaged with frame member 26. Frame member 26 is securable to a beam, also as previously described, and therefore advertising panel 32 is able to be displayed in a wide variety of settings in an aesthetically appealing way.

Thus, the panel fastening assembly in accordance with the present invention provides the ability to mount advertising panels along beams, such as those that form part of a support structure for bleachers, in a wide variety of different arrangements. It will be evident to one skilled in the art that a variety of changes can be made that are within the spirit and scope of the present invention. For instance, the advertising track utilized can be of various lengths such that only a single advertising track and panel may be used to secure one side of an advertising panel to a single frame member mounted on a single beam, or a plurality of shorter advertising track sections can be used along one side of an advertising panel, and those shorter tracks may be engaged with a plurality of frame members that are secured to plurality of beams.

Accordingly, the panel fastening assembly in accordance with the present invention is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

Having now described the features discoveries, and principles of the invention, the manner in which the system for fastening printed material is construed and used, the characteristics of the construction, and the advantageous new and useful results obtained; the new and useful structures, devices, elements, arrangement, parts, and combinations are set forth in the appended claims.

The invention claimed is:

1. A panel fastening assembly comprising:

a frame member adapted to be secured to a beam, said frame member including a top wall, a bottom wall, and a side wall extending between the to and bottom walls;

a first hole defined in one of the top and bottom walls and adapted to receive a fastener therethrough to secure the frame member to the beam;

a second hole defined in the side wall of the frame member;

an advertising track;

an aperture defined in the advertising track;

a rod having a first end and a second end, wherein the second end is received in the aperture in the advertising track;

an opening defined in the first end of the rod;

a fastener extending through the opening and into the second hole in the side wall of the frame member, and wherein the rod couples the frame member and the advertising track together;

a carrier configured to engage the advertising track; and an advertising panel engaged with the carrier.

2. The panel fastening assembly of claim 1 wherein the advertising track defines a chamber and the carrier is received within the advertising track chamber.

3. The panel fastening assembly of claim 2 wherein the advertising track includes a slot in communication with the chamber, said slot being adapted to receive a portion of the advertising panel therethrough.

4. The panel fastening assembly of claim 1 wherein the carrier is releasably locked to the advertising track.

5. The panel fastening assembly of claim 1 wherein the rod releasably locks the carrier to the advertising track.

6. The panel fastening assembly of claim 5 wherein the rod is threaded and the aperture in the advertising track is threaded and wherein the rod is rotated in the aperture in a first direction to lock the carrier to the advertising track and is rotated in a second direction to disengage the carrier from the advertising track.

7. The panel fastening assembly of claim 6 wherein the rod further comprises a nut, wherein the nut prevents the carrier from disengaging from the advertising track.

8. The panel fastening assembly as defined in claim 7, wherein the advertising track defines an interior cavity into which at least a portion of the carrier is received; and wherein the nut is disposed on the rod between the frame and an exterior surface of the track which is disposed adjacent the frame; and the rod extends through the nut, through the aperture in the track and into the interior cavity defined within the track to engage the carrier.

9. The panel fastening assembly of claim 1 wherein the advertising track is rotatable about the rod.

10. The panel fastening assembly of claim 1 wherein a distance between the advertising track and the frame member is adjustable at the rod.

11. The panel fastening assembly of claim 10 wherein the rod controls the distance between the advertising track and the frame member.

12. The panel fastening assembly of claim 1 wherein the top, bottom and side walls of the frame member define a second opening therebetween and this second opening is adapted to receive the beam therein.

13. The panel fastening assembly of claim 12, wherein the first hole is defined in the top wall and an additional hole is defined in the bottom wall the first hole and the additional hole are offset relative to each other.

14. The panel fastening assembly of claim 1 wherein the frame member further includes at least one bolt and an arm having a first end and a second end, and wherein the rod engages the first end of the arm and the at least one bolt engages the second end of the arm.

15. The panel fastening assembly of claim 14 wherein the arm is adjustable in a direction perpendicular to a longitudinal axis of the advertising panel.

16. The panel fastening assembly of claim 1 wherein a portion of the advertising panel surrounds the carrier and the portion of the advertising panel is disposed intermediate the carrier and an inner surface of the advertising track.

17. A method of displaying an advertising panel comprising the steps of:

engaging an advertising panel with a carrier;

attaching a C-shaped frame to a beam by inserting a first fastener through a first hole in one of a top wall and a bottom wall of the frame;

attaching a rod to the frame by inserting a second fastener through an opening at a first end of the rod and into a second hole defined in a side wall of the frame, where the side wall extends between the top and bottom walls thereof;

coupling an advertising track with the carrier;

securing the advertising track to the rod; and moving a second end of the rod through an aperture in the advertising track to engage the carrier and thereby lock the carrier to the advertising track.

18. The method of claim 17 wherein the step of moving the second end of the rod through the aperture in the advertising track further comprises the steps of:

rotating the rod through the aperture to lock the carrier in position; and positioning a nut adjacent the advertising track.

19. The method of claim 17, further comprising the step of tensioning the advertising panel by decreasing the length of the rod between the frame and the advertising track.

* * * * *

UNITED STATES PATENT AND TRADEMARK OFFICE

CERTIFICATE OF CORRECTION

PATENT NO. : 8,745,907 B2
APPLICATION NO. : 12/891932
DATED : June 10, 2014
INVENTOR(S) : Boltz et al.

It is certified that error appears in the above-identified patent and that said Letters Patent is hereby corrected as shown below:

In the Claims:

Column 10, line 26 (Claim 1) “to” should be changed to --top--.

Column 11, line 18 (Claim 13) “bottom wall the first hole” should be changed to --bottom wall and the first hole--.

Signed and Sealed this
Twelfth Day of August, 2014

Michelle K. Lee

Michelle K. Lee
*Deputy Director of the United States Patent and Trademark Office*